US010655814B2

(12) United States Patent
Kosugi

(10) Patent No.: US 10,655,814 B2
(45) Date of Patent: May 19, 2020

(54) VEHICLE LUMINAIRE AND VEHICLE LAMP DEVICE

(71) Applicant: Toshiba Lighting & Technology Corporation, Yokosuka-shi, Kanagawa-ken (JP)

(72) Inventor: Daisuke Kosugi, Yokosuka (JP)

(73) Assignee: Toshiba Lighting & Technology Corporation, Yokosuka-shi, Kanagawa-ken (JP)

( * ) Notice: Subject to any disclaimer, the term of this patent is extended or adjusted under 35 U.S.C. 154(b) by 0 days.

(21) Appl. No.: 16/255,450

(22) Filed: Jan. 23, 2019

(65) Prior Publication Data

US 2019/0383463 A1 Dec. 19, 2019

(30) Foreign Application Priority Data

Jun. 19, 2018 (JP) ..... 2018-115807

(51) Int. Cl.

| | |
|---|---|
| ***F21S 45/47*** | (2018.01) |
| ***F21V 29/83*** | (2015.01) |
| ***F21V 23/00*** | (2015.01) |
| ***F21V 25/10*** | (2006.01) |

(52) U.S. Cl.

CPC ..... *F21S 45/47* (2018.01); *F21V 23/005* (2013.01); *F21V 25/10* (2013.01); *F21V 29/83* (2015.01)

(58) Field of Classification Search

CPC .. F21S 45/47; F21S 45/40; F21S 45/10; F21S 43/14; F21S 41/141; F21V 29/83; F21V 23/005; F21V 25/10; F21V 29/70; F21V 29/74; F21V 29/00; F21V 29/503; F21V 29/502

See application file for complete search history.

(56) References Cited

U.S. PATENT DOCUMENTS

| | | | | |
|---|---|---|---|---|
| 2008/0143275 | A1 | 6/2008 | Hoffman | |
| 2009/0021181 | A1 | 1/2009 | Brune et al. | |
| 2012/0161633 | A1 | 6/2012 | Nishitani et al. | |
| 2013/0193851 | A1 | 8/2013 | Alon et al. | |
| 2014/0160773 | A1 | 6/2014 | Peters et al. | |
| 2016/0245470 | A1* | 8/2016 | Hatanaka | F21S 43/14 |
| 2017/0009953 | A1* | 1/2017 | Kosugi | F21S 45/50 |
| 2017/0223805 | A1* | 8/2017 | Kosugi | H05B 45/37 |

FOREIGN PATENT DOCUMENTS

| | | | |
|---|---|---|---|
| DE | 10 2005 018175 | A1 | 10/2006 |
| EP | 3118059 | A1 | 1/2017 |
| JP | 2000-278859 | A | 10/2000 |
| JP | 2017-159726 | A | 9/2017 |

* cited by examiner

*Primary Examiner* — Bao Q Truong
(74) *Attorney, Agent, or Firm* — Banner & Witcoff, Ltd.

(57) ABSTRACT

A vehicle luminaire includes: a flange; a mount portion provided with a housing portion opened to an end opposite to the flange side; a board provided inside the housing portion; at least one light-emitting element provided on the board; at least one resistance provided on the board and electrically connected to the light-emitting element; at least one control element provided on the board and electrically connected to the light-emitting element, the control element having an electric resistance increasing as a temperature rises; and a temperature control unit configured to control heat generated from at least one of the light-emitting element and the resistance and transferred to the control element via the board or via the board and the mount portion.

17 Claims, 3 Drawing Sheets

VEHICLE LUMINAIRE AND VEHICLE LAMP DEVICE

CROSS-REFERENCE TO RELATED APPLICATIONS

This application is based upon and claims the benefit of priority from Japanese Patent Application No. 2018-115807, filed on Jun. 19, 2018, the entire contents of which are incorporated herein by reference.

FIELD

Embodiments described herein relate generally to a vehicle luminaire and a vehicle lamp device.

BACKGROUND

There is known a vehicle luminaire having a socket and a light-emitting module provided in one end side of the socket. The light-emitting module has a board provided with a wiring pattern and a light-emitting diode (LED) electrically connected to the wiring pattern.

In order to light the vehicle luminaire, a voltage is applied to the vehicle luminaire (light-emitting module). As a voltage is applied to the light-emitting module, a current flows to the light-emitting diode, so that heat is generated, and a temperature of the light-emitting diode increases. Here, when a vehicle luminaire provided in an automobile, the voltage applied to the vehicle luminaire fluctuates. For this reason, an overvoltage significantly increases the temperature of the light-emitting diode, so that a failure may occur in the light-emitting diode, or a service life of the light-emitting diode may be reduced.

In this regard, a technique is proposed, in which a circuit obtained by connecting a resistance and a thermistor (positive temperature coefficient thermistor) in series and a resistance are connected in parallel, so that the thermistor cuts off the current in the event of an overvoltage to allow the current to flow only to the resistance connected in parallel. As a result, in the event of an overvoltage, a value of the resistance connected in series to the light-emitting diode increases. Therefore, it is possible to suppress the temperature of the light-emitting diode from excessively increasing.

Meanwhile, if the number or specification of the light-emitting diode changes, or a distance between the light-emitting diode and the thermistor changes, the temperature of the thermistor changes. For this reason, it is necessary to select a thermistor having a suitable Curie point and a suitable resistance value depending on the specification, size, use purpose, or the like of the vehicle luminaire.

However, if the thermistor is selected depending on the specification of the vehicle luminaire or the like, it is necessary to stock a plurality of types of thermistors. In addition, it may be difficult to find a thermistor having an optimum Curie point and an optimum resistance value, and the thermistor may not operate at a desired temperature in some cases.

In this regard, development of a technology capable of controlling the temperature of the control element such as a thermistor is demanded.

DETAILED DESCRIPTION

Figure 1:
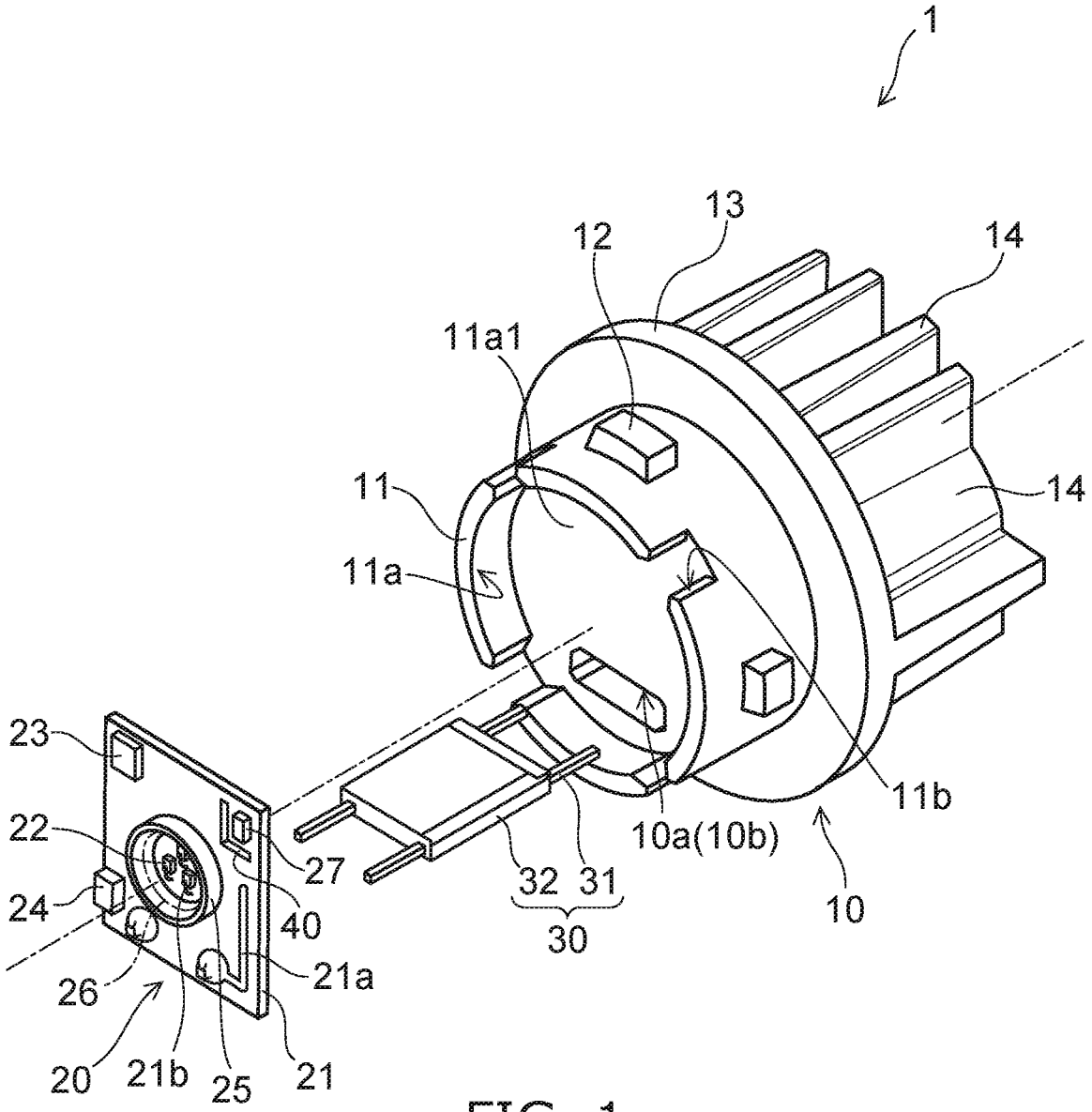
FIG. 1 is a schematic exploded view illustrating a vehicle luminaire according to an embodiment.

A vehicle luminaire according to an embodiment includes: a flange; a mount portion provided on one side of the flange and provided with a housing portion opened to an end opposite to the flange side; a board provided inside the housing portion; at least one light-emitting element provided on a side of the board opposite to a bottom face side of the housing portion; at least one resistance provided on a side of the board opposite to the bottom face side of the housing portion and electrically connected to the light-emitting element; at least one control element provided on a side of the board opposite to the bottom face side of the housing portion and electrically connected to the light-emitting element, the control element having an electric resistance increasing as a temperature rises; and a temperature control unit configured to control heat generated from at least one of the light-emitting element and the resistance and transferred to the control element via the board or via the board and the mount portion.

Embodiments will now be described by way of example with reference to the accompanying drawings. Note that like reference numerals denote like elements throughout the drawings, and they will not be described repeatedly.

(Vehicle Luminaire)

A vehicle luminaire 1 according to this embodiment may be provided, for example, in an automobile, a railroad vehicle, or the like. The vehicle luminaire 1 provided in the automobile may include, for example, a front combination light (such as a combination of a daylight running lamp (DRL), a position lamp, and a turn signal lamp), a rear combination light (such as a combination of a stop lamp, a tail lamp, a turn signal lamp, a back lamp, and a fog lamp), or the like. However, the use purpose of the vehicle luminaire 1 is not limited thereto.

FIG. 1 is a schematic exploded view illustrating vehicle luminaire 1 according to this embodiment.

Figure 2:
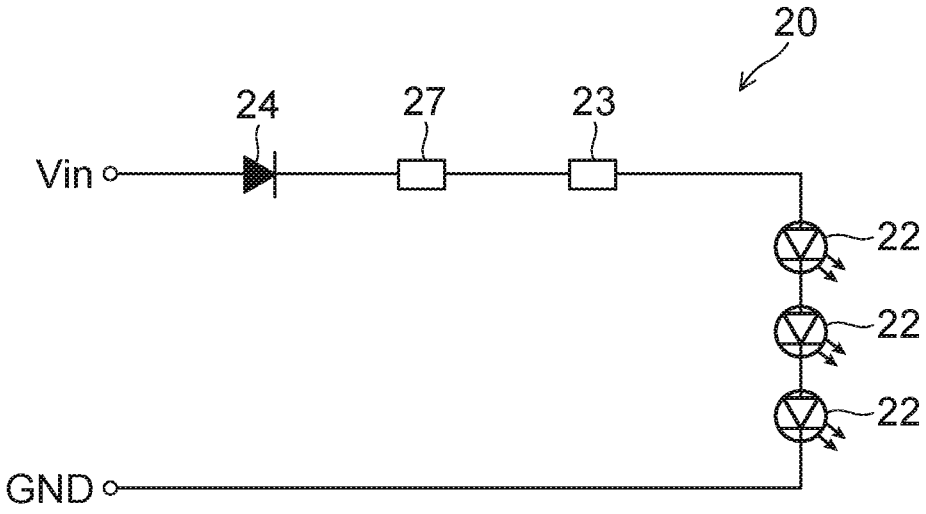
FIG. 2 is a circuit diagram illustrating a light-emitting module.

FIG. 2 is a circuit diagram illustrating a light-emitting module 20.

As illustrated in FIG. 1, the vehicle luminaire 1 has a socket 10, a power-supply unit 30, a light-emitting module 20, and a temperature control unit 40.

The socket 10 has a mount portion 11, a bayonet 12, a flange 13, and a thermal radiation fin 14.

The mount portion 11 is provided on a side of the flange 13 opposite to a side where the thermal radiation fin 14 is provided. An exterior shape of the mount portion 11 may be a columnar shape. The exterior shape of the mount portion 11 is, for example, a cylindrical shape. The mount portion 11 has a housing portion 11*a* hollowed and opened to an end opposite to the flange 13 side.

The mount portion 11 may have at least one slit 11*b*. Corners of the board 21 are provided in the inside of the slits 11*b*. A dimension (width) of the slit lib in a circumferential direction of the mount portion 11 is slightly larger than that of the corner of the board 21. For this reason, the board 21 is positioned by inserting the corner of the board 21 into the inside of the slit 11*b*.

If the slit 11*b* is provided, it is possible to enlarge a planar shape of the board 21. For this reason, it is possible to increase the number of elements mounted on the board 21. In addition, since the exterior dimension of the mount portion 11 can be reduced, it is possible to facilitate miniaturization of the mount portion 11 and further, miniaturization of the vehicle luminaire 1.

A plurality of bayonets 12 are provided on an outer side surface of the mount portion 11. A plurality of bayonets 12 protrude outward of the vehicle luminaire 1. A plurality of bayonets 12 face the flange 13. A plurality of bayonets 12 are used to install the vehicle luminaire 1 in a casing 101 of a vehicle lamp device 100. A plurality of bayonets 12 are used for twist locking.

The flange 13 has a plate shape. The flange 13 may have, for example, a disk shape. An outer side surface of the flange 13 is located outward of the vehicle luminaire 1 relative to an outer side surface of the bayonet 12.

The thermal radiation fin 14 is provided on a side of the flange 13 opposite to the mount portion 11 side. At least one thermal radiation fin 14 may be provided. The socket 10 of FIG. 1 is provided with a plurality of thermal radiation fins. A plurality of thermal radiation fins 14 may be arranged side by side along a predetermined direction. The thermal radiation fins 14 may have a plate shape.

The socket 10 further has holes 10*a* and 10*b*. One end of the hole 10*a* is opened to a bottom face 11*a*1 of the housing portion 11*a*. An insulating portion 32 is provided inside the hole 10*a*. One end of the hole 10*b* is connected to the other end of the hole 10*a*. The other end of the hole 10*b* is opened to the thermal radiation fin 14 side of the socket 10. A connector 105 having a seal member 105*a* is inserted into the hole 10*b*. For this reason, a cross-sectional shape of the hole 10*b* is formed to match a cross-sectional shape of the connector 105 having the seal member 105*a*.

The heat generated in the light-emitting module 20 is principally transferred to the thermal radiation fins 14 via the mount portion 11 and the flange 13. The heat transferred to the thermal radiation fins 14 are radiated to the outside from the thermal radiation fins 14.

In this case, the socket 10 can efficiently radiate the heat generated in the light-emitting module 20 and is preferably light-weighted. For this reason, considering transfer of the heat generated in the light-emitting module 20, the socket 10 is preferably formed of a material having a high heat conductivity. The material having a high thermal conductivity may include, for example, metal such as aluminum or an aluminum alloy, high thermal conductivity resin, or the like. The high thermal conductivity resin is obtained by mixing a filler using an inorganic material with resin such as polyethylene terephthalate (PET), polybutylene terephthalate (PBT), or nylon. The filler may include, for example, ceramics such as aluminum oxide, carbon, or the like. By forming the socket 10 using the high thermal conductivity resin, it is possible to efficiently radiate the heat generated in the light-emitting module 20 and achieve miniaturization.

The mount portion 11, the bayonets 12, the flange 13, and the thermal radiation fins 14 may be integrally molded through die casting, injection molding, or the like. By integrally molding these elements, it is possible to facilitate heat transfer and thus improve a heat radiation property. In addition, it is possible to facilitate manufacturing cost reduction, miniaturization, weight reduction, or the like.

The power-supply unit 30 has a plurality of power-supply terminals 31 and an insulating portion 32.

A plurality of power-supply terminals 31 may be formed, for example, in a bar shape. A plurality of power-supply terminals 31 protrude from the bottom face 11*a*1 of the housing portion 11*a*. A plurality of power-supply terminals 31 may be arranged side by side along a predetermined direction. A plurality of power-supply terminals 31 are provided inside the insulating portion 32. A plurality of power-supply terminals 31 extend through the inside of the insulating portion 32 and protrude from an end of the light-emitting module 20 side of the insulating portion 32 and an end of the thermal radiation fin 14 side of the insulating portion 32. Ends of the light-emitting module 20 side of a plurality of power-supply terminals 31 are electrically and mechanically connected to a wiring pattern 21*a* of the board 21. That is, one end of the power-supply terminal 31 is soldered to the wiring pattern 21*a*. Ends of the thermal radiation fin 14 side of a plurality of power-supply terminals 31 are exposed to the inside of the hole 10*b*. The connector 105 is fitted to a plurality of power-supply terminals 31 exposed to the inside of the hole 10*b*. The power-supply terminal 31 has an electric conductivity. The power-supply terminal 31 may be formed of, for example, metal such as a copper alloy. Note that the number, shape, arrangement, material, or the like of the power-supply terminal 31 are not limited to those illustrated, but may be appropriately changed.

As described above, the socket 10 is preferably formed of a material having a high heat conductivity. However, the material having a high heat conductivity has an electric conductivity in some cases. For example, the high thermal conductivity resin or the like containing a filler formed of carbon has an electric conductivity. For this reason, the insulating portion 32 is provided to insulate the power-supply terminal 31 from the conductive socket 10. In addition, the insulating portion 32 also has a function of holding a plurality of power-supply terminals 31. Note that, when the socket 10 is formed of high thermal conductivity resin having an insulating property (such as high thermal conductivity resin including a filler formed of ceramics or the like), the insulating portion 32 may be omitted. In this case, the socket 10 holds a plurality of power-supply terminals 31

The insulating portion 32 is provided between a plurality of power-supply terminals 31 and the socket 10. The insulating portion 32 has an insulating property. The insulating portion 32 may be formed of resin having an insulating property. The insulating portion 32 may be formed of, for example, PET, nylon, or the like. The insulating portion 32 is provided inside the hole 10*a* of the socket 10.

The light-emitting module 20 is provided in one end of the socket 10. The light-emitting module 20 may be provided inside the housing portion 11*a*.

The light-emitting module 20 has a board 21, a light-emitting element 22, a resistance 23, a diode 24, a frame 25, a sealing portion 26, and a control element 27.

The board 21 is provided inside the housing portion 11*a*. The board 21 may be provided, for example, on the bottom face 11*a*1 of the housing portion 11*a*. The board 21 has a plate shape. The planar shape of the board 21 may be, for example, a rectangular shape. A material or structure of the board 21 is not particularly limited. For example, the board 21 may be formed of an inorganic material such as ceramics (for example, aluminum oxide, aluminum nitride, or the like), an organic material such as paper phenol or glass epoxy, or the like. In addition, the board 21 may be formed by coating an insulating material on a surface of a metal plate. Note that, when the surface of the metal plate is coated with an insulating material, the insulating material may contain either an organic material or an inorganic material. When the heat amount radiated from the light-emitting element 22 is large, the board 21 is preferably formed of a material having a high heat conductivity from the viewpoint of heat radiation. The material having a high heat conductivity may include, for example, ceramics such as aluminum oxide or aluminum nitride, high thermal conductivity resin, a metal plate coated with an insulating material, or the like. In addition, the board 21 may have either a single layer structure or a multilayer structure.

A wiring pattern 21*a* is provided on a surface of the board 21. The wiring pattern 21*a* may be formed of, for example, a material containing copper as a main component. However, the material of the wiring pattern 21*a* is not limited to the material containing copper as a main component. The wiring pattern 21*a* may be formed of, for example, a material containing silver as a main component, or the like. The wiring pattern 21*a* may be formed of, for example, silver or a silver alloy.

The light-emitting element 22 is provided on a face of the board 21 opposite to the bottom face 11*a*1 side of the housing portion 11*a*, The light-emitting element 22 is provided on the board 21. The light-emitting element 22 is electrically connected to the wiring pattern 21*a* provided on a surface of the board 21. The light-emitting element 22 may include, for example, a light-emitting diode, an organic light-emitting diode, a laser diode, or the like. At least one light-emitting element 22 may be provided. The light-emitting module 20 of FIGS. 1 and 2 has a plurality of light-emitting elements 22. A plurality of light-emitting elements 22 may be connected to each other in series.

The light-emitting element 22 may be a chip type light-emitting element. The chip type light-emitting element 22 is embedded in a chip-on-board (COB). As a result, it is possible to provide a large number of light-emitting elements 22 in a narrow area. For this reason, it is possible to facilitate miniaturization of the light-emitting module 20 and further miniaturization of the vehicle luminaire 1. The light-emitting element 22 is electrically connected to the wiring pattern 21*a* with a wire 21*b*. The light-emitting element 22 and the wiring pattern 21*a* may be electrically connected, for example, using a wire bonding method. The light-emitting element 22 may be an upper/lower electrode type light-emitting element, an upper electrode type light-emitting element, a flip-chip type light-emitting element, or the like. Note that the light-emitting element 22 of FIG. 1 is the upper/lower electrode type light-emitting element. When the light-emitting element 22 is the flip-chip type light-emitting element, the light-emitting element 22 is directly connected to the wiring pattern 21*a*.

The light-emitting element 22 may be a surface-mounted light-emitting element or a shell type light-emitting element having a lead wire.

The resistance 23 is provided on a face of the board 21 opposite to the bottom face 11*a*1 side of the housing portion 11*a*. The resistance 23 is provided on the board 21. The resistance 23 is electrically connected to the wiring pattern 21*a* provided on a surface of the board 21. The resistance 23 is electrically connected to the light-emitting element 22. At least one resistance 23 may be provided. The resistance 23 may be, for example, a surface-mounted resistor, a resistor having a lead wire (metal oxide film resistor), a film type resistor formed by a screen print method, or the like. Note that the resistance 23 of FIG. 1 is a surface-mounted resistor.

Here, since a forward bias characteristic of the light-emitting element 22 has a variation, a variation occurs in brightness (light flux, luminance, light intensity, or illuminance) of light irradiated from the light-emitting element 22 when a constant voltage is applied between an anode terminal and a ground terminal. For this reason, a current value flowing to the light-emitting element 22 is controlled to a predetermined range using the resistance 23 such that the brightness of light emitted from the light-emitting element 22 is within a predetermined range. In this case, the current value flowing through the light-emitting element 22 is controlled to a predetermined range by changing a resistance value of the resistance 23.

When the resistance 23 is a surface-mounted resistor, a resistor having a lead wire, or the like, a resistance 23 having a suitable resistance value is selected depending on a forward bias characteristic of the light-emitting element 22. When the resistance 23 is a film type resistor, the resistance value can increase by removing a part of the resistance 23. For example, a part of the resistance 23 can be easily removed by irradiating the resistance 23 with laser light.

The diode 24 is provided on a face of the board 21 opposite to the bottom face 11*a*1 side of the housing portion 11*a*. The diode 24 is provided on the board 21. The diode 24 is electrically connected to the wiring pattern 21*a* provided on a surface of the board 21. The diode 24 is electrically connected to the light-emitting element 22. The diode 24 is provided to prevent a reverse voltage from being applied to the light-emitting element 22 and prevent a reverse pulse noise from being applied to the light-emitting element 22.

The diode 24 may include, for example, a surface-mounted diode, a diode having a lead wire, or the like. The diode 24 of FIG. 1 is a surface-mounted diode.

In the case of a chip type light-emitting element 22, a frame 25 and a sealing portion 26 may be provided.

The frame 25 may be provided on a face of the board 21 opposite to the bottom face 11*a*1 side of the housing portion 11*a*. The frame 25 may be provided on the board 21. The frame 25 may be bonded to the board 21. The frame 25 has, for example, an annular shape to accommodate a plurality of light-emitting elements 22 therein. That is, the frame 25 may surround a plurality of light-emitting elements 22. The frame 25 may be formed of resin. The resin may include, for example, thermoplastic resin such as PBT, polycarbonate (PC), PET, nylon, polypropylene (PP), polyethylene (PE), or polystyrene (PS).

A reflectance to the light emitted from the light-emitting element 22 may be improved by mixing particles such as titanium oxide with the resin. Note that any particle formed of a material having a high reflectance to the light emitted from the light-emitting element 22 may be mixed without limiting to the titanium oxide particle. In addition, the frame 25 may be formed of, for example, white resin.

The inner wall surface of the frame 25 is sloped to be widened from a center axis of the frame 25 as a distance from the board 21 increases. For this reason, a part of the light emitted from the light-emitting element 22 is reflected on the inner wall surface of the frame 25 and is emitted toward a front face side of the vehicle luminaire 1. That is, the frame 25 may have a function of defining a range of the sealing portion 26 and a function of a reflector.

The sealing portion 26 is provided in the inside of the frame 25. The sealing portion 26 is provided to cover the inside of the frame 25. That is, the sealing portion 26 is provided in the inside of the frame 25 to cover the light-emitting element 22 or the wire 21*b*. The sealing portion 26 is formed of a light transmissive material. The sealing portion 26 may be formed, for example, by filling resin in the inside of the frame 25. The resin may be filled using a liquid quantitative discharge device such as a dispenser. The resin to be filled may include, for example, silicon resin or the like.

The sealing portion 26 may contain phosphor. The phosphor may include, for example, yttrium-aluminum-garnet-based (YAG-based) phosphor. However, the type of the phosphor may be appropriately changed such that a desired luminescent color can be obtained depending on the use purpose of the vehicle luminaire 1 or the like.

Only the sealing portion 26 may be provided without the frame 25. When only the sealing portion 26 is provided, a dome-shaped sealing portion 26 is provided on the board 21.

The control element 27 is provided on a face of the board 21 opposite to the bottom face 11*a*1 side of the housing portion 11*a*. The control element 27 is provided on the board 21. The control element 27 is electrically connected to the wiring pattern 21*a* provided on a surface of the board 21. The control element 27 is electrically connected to the light-emitting element 22. The control element 27 may have an electric resistance increasing as a temperature rises. The control element 27 may be, for example, a positive temperature coefficient thermistor. When the control element 27 is a positive temperature coefficient thermistor, the resistance value of the control element 27 increases when the temperature of the control element 27 exceeds the Curie point.

Note that, in the following description, it is assumed that the control element 27 is a positive temperature coefficient thermistor by way of example.

At least one control element 27 may be provided. The number of the control elements 27 may be appropriately changed depending on a total current value to be set. When a plurality of control elements 27 are provided, a plurality of control elements 27 may be connected to each other in parallel. In addition, a plurality of control elements 27 connected in parallel may be connected in series to a plurality of light-emitting elements 22 connected in series.

Here, a voltage is applied to the light-emitting module 20 in order to light the vehicle luminaire 1. Then, a current flows to the light-emitting element 22, and heat is generated, so that the temperature of the light-emitting element 22 increases.

The vehicle luminaire 1 has a battery as a power-supply. However, the voltage applied to the vehicle luminaire 1 fluctuates. For example, an operational standard voltage (rated voltage) of the vehicle luminaire 1 of a typical vehicle is set to 13.5 V or so. However, a voltage higher than the rated voltage may be applied in some cases. As a voltage applied to the light-emitting module 20 increases, the temperature of the light-emitting element 22 excessively increases, so that the light-emitting element 22 may be failed, or a service life of the light-emitting element 22 may be reduced.

In this regard, the light-emitting module 20 has the control element 27. As a voltage is applied to the vehicle luminaire 1 (light-emitting module 20), and a current flows to the control element 27, Joule heat is generated, and the temperature of the control element 27 increases. In this case, as the input voltage yin increases, the temperature of the control element 27 increases accordingly. As described above, as the temperature of the control element 27 exceeds the Curie point, the resistance value of the control element 27 increases. As the resistance value of the control element 27 increases, the current flowing to the light-emitting element 22 is reduced, so that it is possible to prevent a temperature increase of the light-emitting element 22. For example, the control element 27 may be selected such that the resistance value does not increase until the input voltage Vin reaches 12 to 14.5 V.

The aforementioned example is based on a case where self-heating of the control element 27 is taken into consideration. However, in practice, the Joule heat is generated from the light-emitting element 22 or the resistance 23, and a part of the generated heat is transferred to the control element 27 via the board 21 or the socket 10 (mount portion 11). That is, the temperature of the control element 27 is influenced by self-heating and thermal interference of the light-emitting element 22 or the like. Since the self-heating is almost determined by the input voltage yin, a variation is insignificant even when the specification, size, use purpose, or the like of the vehicle luminaire 1 changes. In comparison, the thermal interference may change significantly when the numbers or specifications of the light-emitting element 22 and the resistance 23, a distance between the light-emitting element 22 and the control element 27, or the like change.

In this case, a control element 27 having a suitable Curie point and a suitable resistance value may be selected in consideration of the self-heating and the thermal interference.

However, in this case, a plurality of types of control elements 27 are necessary depending on the specification of the vehicle luminaire 1. In addition, in some cases, it may be difficult to obtain the control element 27 having an optimum Curie point and an optimum resistance value, and the control element 27 may not operate at a desired temperature in some cases.

In this regard, the vehicle luminaire 1 has a temperature control unit 40.

As described below, the temperature control unit 40 controls the heat generated from at least one of the light-emitting element 22 and the resistance 23 and transferred to the control element 27 via the board 21 or via the board 21 and the mount portion 11.

The temperature control unit 40 has at least one of a hole, a hollow, and a notch provided in the board 21. Note that the hole may penetrate a thickness direction of the board 21. The hollow may be, for example, a bottomed hole. The notch may be, for example, a hole or hollow opened to a peripheral edge of the board 21. The temperature control unit 40 of FIG. 1 is a hole penetrating the thickness direction of the board 21.

The temperature control unit 40 may be provided in at least between the light-emitting element 22 and the control element 27 or between the resistance 23 and the control element 27. Since, in general, a heat generation amount of the light-emitting element 22 is larger than that of the resistance 23, the temperature control unit 40 is preferably provided at least between the light-emitting element 22 and the control element 27. The temperature control unit 40 of FIG. 1 is provided between the light-emitting element 22 and the control element 27 and between the resistance 23 and the control element 27.

A material having a heat conductivity lower than that of the material of the board 21 may be filled in the inside of the temperature control unit 40. As a result, it is possible to suppress heat transfer to the control element 27. For example, the inside of the temperature control unit 40 may be filled with air. That is, the inside of the temperature control unit 40 may be a cavity. Alternatively, the inside of the temperature control unit 40 may be filled with a material having a low heat conductivity such as resin. However, if the inside of the temperature control unit 40 is a cavity, it is possible to reduce influence of thermal interference and reduce a manufacturing cost.

The inside of the temperature control unit 40 may be filled with a material having a heat conductivity higher than that of the material of the board 21. As a result, it is possible to easily transfer heat to the control element 27. For example, when it is necessary to use the control element 27 having a Curie point higher than a desired Curie point, it is preferable to increase influence of the thermal interference to easily increase the temperature of the control element 27. For example, the inside of the temperature control unit 40 may be filled with metal such as copper or aluminum.

That is, the inside of the temperature control unit 40 may be filled with a material having a heat conductivity different from that of the material of the board 21. However, in recent years, the size of the vehicle luminaire 1 tends to decrease, that is, miniaturization of the light-emitting module 20 is progressing. In addition, the luminance of the light-emitting module 20 is also increasing. For this reason, influence of the thermal interference tends to increase. Therefore, the inside of the temperature control unit 40 is preferably filled with a material having a heat conductivity lower than that of the material of the board 21.

Note that a planar size, a planar shape, and the number of the temperature control unit 40, a distance between the control element 27 and the temperature control unit 40, the material to be filled, and the like may be appropriately determined by performing experiments, simulations, or the like.

As described above, when the temperature control unit 40 is provided, it is possible to control the heat transferred to the control element 27 via the board 21 and further to control the temperature of the control element 27. For this reason, even when the specification or the like of the vehicle luminaire 1 changes, the control element 27 can operate at a desired temperature, so that it is possible to share the control element 27. As a result, it is possible to reduce the types of the control elements 27 to be stocked, and thus reduce the manufacturing cost of the vehicle luminaire 1.

Figure 3:
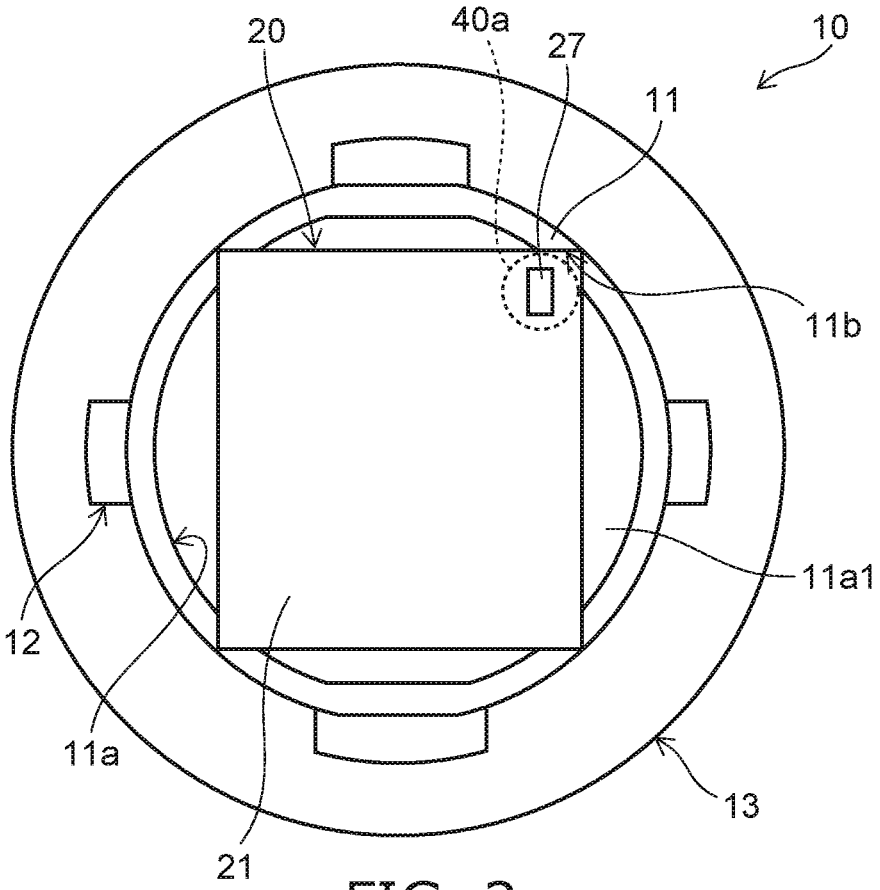
FIG. 3 is a schematic plan view illustrating a temperature control unit according to another embodiment.

FIG. 3 is a schematic plan view illustrating a temperature control unit 40*a* according to another embodiment.

Note that, in FIG. 3, the light-emitting element 22, the resistance 23, the diode 24, the frame 25, the sealing portion 26, and the like are omitted for simplicity purposes.

As illustrated in FIG. 3, the temperature control unit 40*a* may be provided on the bottom face 11*a*1 of the housing portion 11*a*. The temperature control unit 40*a* has at least one of a hole, a hollow, and a notch provided on the bottom face 11*a*1. Note that the hole may penetrate, for example, a center axis direction of the socket 10. The hollow may be, for example, a bottomed hole. The notch may be, for example, a hole or hollow opened to the outer surface of the mount portion 11. The temperature control unit 40*a* of FIG. 3 is a hollow provided on the bottom face 11*a*1. As seen in a plan view (as the vehicle luminaire 1 is seen from the light-emitting module 20 side), the temperature control unit 40*a* may be provided at least in a position of the control element 27, between the light-emitting element 22 and the control element 27, or between the resistance 23 and the control element 27. In this case, if the temperature control unit 40*a* is provided in the position of the control element 27 as seen in a plan view, it is possible to control both the heat from the light-emitting element 22 and the heat from the resistance 23. The temperature control unit 40*a* of FIG. 3 is a hollow provided in the position of the control element 27 as seen in a plan view.

The inside of the temperature control unit 40*a* may be filled with a material having a heat conductivity lower than that of the material of the mount portion 11, or a material having a heat conductivity higher than that of the material of the mount portion 11. That is, the inside of the temperature control unit 40*a* may be filled with a material having a heat conductivity different from that of the material of the mount portion 11.

Note that, when a material having a heat conductivity higher than that of the material of the mount portion 11 is filled, the temperature control unit 40*a* may be shaped to extend between the light-emitting element 22 and the control element 27 or between the resistance 23 and the control element 27 as seen in a plan view.

As described above, since the thermal interference tends to increase in recent years, the inside of the temperature control unit 40*a* is preferably filled with a material having a heat conductivity lower than that of the material of the mount portion 11. The material to be filled may be similar to, for example, that of the temperature control unit 40 described above.

Note that a planar size, a planar shape, and the number of the temperature control unit 40*a*, a distance between the control element 27 and the temperature control unit 40*a*, the material to be filled, and the like may be appropriately determined by performing experiments, simulations, or the like.

Figure 4:
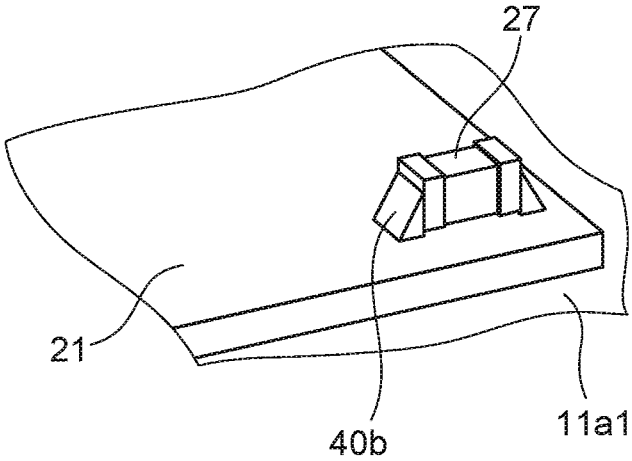
FIG. 4 is a schematic plan view illustrating a temperature control unit according to further another embodiment.

As described above, when the temperature control unit 40*a* is provided, it is possible to control the heat transferred to the control element 27 via the mount portion 11 and further to control the temperature of the control element 27. For this reason, even when the specification or the like of the vehicle luminaire 1 changes, the control element 27 can operate at a desired temperature, so that it is possible to share the control element 27. As a result, it is possible to reduce the types of the control elements 27 to be stocked, and thus reduce the manufacturing cost of the vehicle luminaire 1, FIG. 4 is a schematic plan view illustrating a temperature control unit 40*b* according to further another embodiment.

The temperature control unit 40*b* may be provided between the board 21 and the control element 27. For example, as illustrated in FIG. 4, the temperature control unit 40*b* may be provided between a side face of the control element 27 and the board 21.

Similar to the temperature control unit 40 described above, the temperature control unit 40*b* may have a heat conductivity different from that of the material of the board 21. As described above, since the thermal interference tends to increase in recent years, the heat conductivity of the material of the temperature control unit 40*b* is preferably lower than that of the material of the board 21. For example, the temperature control unit 40*b* may be formed using a conductive adhesive instead of the solder. Note that the temperature control unit 40*b* may be a sheet or the like provided between the lower face of the control element 27 and the board 21.

Note that a size, a shape, a material, and the number, or the like of the temperature control unit 40*b* may be appropriately determined by performing experiments, simulations, or the like.

As described above, when the temperature control unit 40*b* is provided, it is possible to control the heat transferred to the control element 27 via the board 21 and further to control the temperature of the control element 27. For this reason, even when the specification or the like of the vehicle luminaire 1 changes, the control element 27 can operate at a desired temperature, so that it is possible to share the control element 27. As a result, it is possible to reduce the types of the control elements 27 to be stocked, and thus reduce the manufacturing cost of the vehicle luminaire 1.

Note that the temperature control units 40, 40*a*, and 40*b* may be combined with each other.

(Vehicle Lamp Device)

Next, a vehicle lamp device 100 will be described.

Note that, in the following description, it is assumed that the vehicle lamp device 100 is a front combination light provided in an automobile. However, the vehicle lamp device 100 is not limited to the front combination light provided in an automobile. The vehicle lamp device 100 may be a vehicle lamp device provided in an automobile, a railroad vehicle, or the like.

Figure 5:
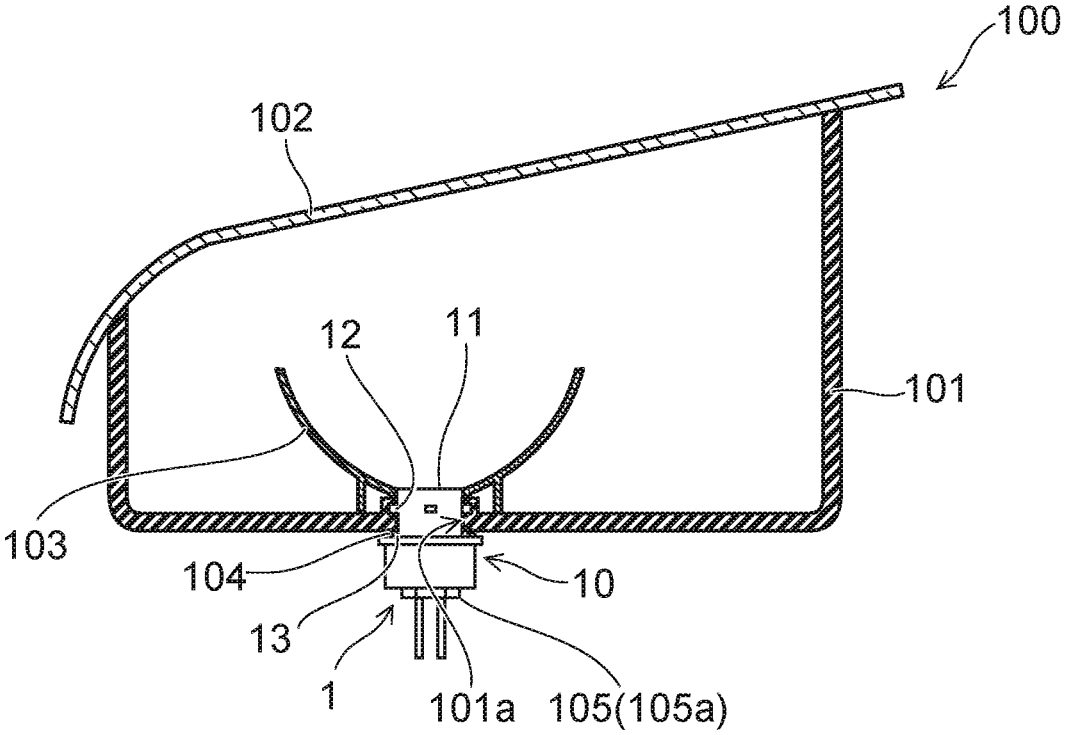
FIG. 5 is a schematic partial cross-sectional view illustrating a vehicle lamp device.

FIG. 5 is a schematic partial cross-sectional view illustrating the vehicle lamp device 100.

As illustrated in FIG. 5, the vehicle lamp device 100 has a vehicle luminaire 1, a casing 101, a cover 102, an optical element unit 103, a seal member 104, and a connector 105.

The vehicle luminaire 1 is installed in the casing 101. The casing 101 holds the mount portion 11. The casing 101 has a box shape whose one end side is opened. The casing 101 may be formed of, for example, resin or the like that does not transmit light. A bottom face of the casing 101 is provided with an installation hole 101*a* into which a part of the mount portion 11 where the bayonet 12 is provided is inserted. A peripheral edge of the installation hole 101*a* has a hollow into which the bayonet 12 of the mount portion 11 is inserted. Note that, although it is assumed that the installation hole 101*a* is directly provided in the casing 101 in this case, an installation member of the installation hole 101*a* may be provided in the casing 101.

In order to install the vehicle luminaire 1 in the vehicle lamp device 100, a part of the mount portion 11 where the bayonet 12 is provided is inserted into the installation hole 101*a*, and the vehicle luminaire 1 is rotated. Then, the bayonet 12 is held by the hollow provided in the peripheral edge of the installation hole 101*a*. Such an installation method is called twist locking.

The cover 102 is provided to block the opening of the casing 101. The cover 102 may be formed of light transmissive resin or the like. The cover 102 may have a function of a lens or the like.

The light emitted from the vehicle luminaire 1 is incident to the optical element unit 103. The optical element unit 103 performs reflection, diffusion, light guiding, condensation, formation of a predetermined luminous intensity distribution pattern, or the like for the light emitted from the vehicle luminaire 1.

For example, the optical element unit 103 of FIG. 5 is a reflector. In this case, the optical element unit 103 reflects the light emitted from the vehicle luminaire 1 to form a predetermined luminous intensity distribution pattern.

The seal member 104 is provided between the flange 13 and the casing 101. The seal member 104 may have an annular shape. The seal member 104 may be formed of a material having elasticity such as rubber or silicon resin.

When the vehicle luminaire 1 is installed in the vehicle lamp device 100, the seal member 104 is interposed between the flange 13 and the casing 101. For this reason, the internal space of the casing 101 is sealed by the seal member 104. In addition, the bayonet 12 is pressed to the casing 101 by virtue of an elastic force of the seal member 104. For this reason, it is possible to suppress the vehicle luminaire 1 from being uninstalled from the casing 101.

The connector 105 is fitted to ends of a plurality of power-supply terminals 31 exposed to the inside of the hole 10*b*. A power-supply or the like (not shown) is electrically connected to the connector 105. For this reason, by fitting the connector 105 to ends of a plurality of power-supply terminals 31, the power-supply or the like (not shown) and the light-emitting element 22 are electrically connected to each other.

The connector 105 has a stepped portion. In addition, the seal member 105*a* is installed in the stepped portion. The seal member 105*a* is provided to prevent water from intruding to the inside of the hole 10*b*. When the connector 105 having the seal member 105*a* is inserted into the hole 10*b*, the hole 10*b* is water-tightly sealed.

The seal member 105*a* may have an annular shape. The seal member 105*a* may be formed of an elastic material such as rubber or silicon resin. The connector 105 may be bonded to an element of the socket 10 side, for example, using an adhesive or the like.

While certain embodiments have been described, these embodiments have been presented by way of example only, and are not intended to limit the scope of the inventions. Indeed, the novel embodiments described herein may be embodied in a variety of other forms; furthermore, various omissions, substitutions and changes in the form of the embodiments described herein may be made without departing from the spirit of the inventions. The accompanying claims and their equivalents are intended to cover such forms or modifications as would fall within the scope and spirit of the inventions. Moreover, above-mentioned embodiments can be combined mutually and can be carried out.

What is claimed is:

1. A vehicle luminaire comprising:

a flange;

a mount portion provided on one side of the flange and provided with a housing portion opened to an end opposite to the flange side;

a board provided inside the housing portion;

at least one light-emitting element provided on a side of the board opposite to a bottom face side of the housing portion;

at least one resistance provided on a side of the board opposite to the bottom face side of the housing portion and electrically connected to the light-emitting element;

at least one control element provided on a side of the board opposite to the bottom face side of the housing portion and electrically connected to the light-emitting element, the control element having an electric resistance increasing as a temperature rises; and a temperature control unit configured to control heat generated from at least one of the light-emitting element and the resistance and transferred to the control element via the board or via the board and the mount portion.

2. The luminaire according to claim 1, wherein the temperature control unit has at least one of a hole, a hollow, and a notch provided on the board.

3. The luminaire according to claim 2, wherein the temperature control unit is provided at least between the light-emitting element and the control element or between the resistance and the control element.

4. The luminaire according to claim 1, wherein the temperature control unit is provided at least in a position of the control element, between the light-emitting element and the control element, or between the resistance and the control element as seen in a plan view.

5. The luminaire according to claim 1, wherein the temperature control unit is provided between the board and the control element.

6. The luminaire according to claim 2, wherein a material having a heat conductivity different from that of a material of the board is provided inside the temperature control unit.

7. The luminaire according to claim 6, wherein a material having a heat conductivity lower than that of a material of the board is provided inside the temperature control unit.

8. The luminaire according to claim 7, wherein the material having a heat conductivity lower than that of the material of the board is air or resin.

9. The luminaire according to claim 6, wherein a material having a heat conductivity higher than that of a material of the board is provided inside the temperature control unit.

10. The luminaire according to claim 9, wherein the material having a heat conductivity higher than that of the material of the board is metal.

11. The luminaire according to claim 5, wherein a heat conductivity of a material of the temperature control unit is lower than that of a material of the board.

12. The luminaire according to claim 11, wherein a material of the temperature control unit includes a conductive adhesive.

13. The luminaire according to claim 1, wherein the control element is a positive temperature coefficient thermistor.

14. The vehicle luminaire according to claim 1, wherein the mount portion includes metal.

15. The luminaire according to claim 1, wherein the mount portion includes high thermal conductivity resin.

16. The luminaire according to claim 1, wherein the board includes ceramics.

17. A vehicle lamp device comprising:

the vehicle luminaire according to claim 1; and a casing in which the vehicle luminaire is installed.

* * * * *